US007491017B2

(12) United States Patent
Blaschke

(10) Patent No.: US 7,491,017 B2
(45) Date of Patent: Feb. 17, 2009

(54) SURFACE DRAINAGE SYSTEM

(75) Inventor: Markus Blaschke, Fockbek (DE)

(73) Assignee: ACO Severin Ahlmann GmbH & Co. KG, Rendsburg (DE)

( * ) Notice: Subject to any disclaimer, the term of this patent is extended or adjusted under 35 U.S.C. 154(b) by 361 days.

(21) Appl. No.: 11/339,174

(22) Filed: Jan. 25, 2006

(65) Prior Publication Data

US 2006/0120802 A1 Jun. 8, 2006

Related U.S. Application Data

(63) Continuation of application No. PCT/EP2004/008301, filed on Jul. 23, 2004.

(30) Foreign Application Priority Data

Jul. 30, 2003 (DE) ..... 103 34 835
Sep. 26, 2003 (DE) ..... 103 44 828

(51) Int. Cl.
*E02B 13/00* (2006.01)

(52) U.S. Cl. ..... 405/121; 405/118; 405/119; 404/2

(58) Field of Classification Search ..... 405/118, 405/119, 121; 404/2–5
See application file for complete search history.

(56) References Cited

U.S. PATENT DOCUMENTS 5,655,564 A * 8/1997 Gavin ..... 137/363
6,027,283 A * 2/2000 Schweinberg et al. ..... 405/42
6,666,349 B1 * 12/2003 Gavin ..... 220/567.1
6,669,405 B1 12/2003 Rhodes
7,303,357 B2 * 12/2007 Villarreal et al. ..... 405/36
2002/0150428 A1 10/2002 Rhodes
2007/0177941 A1 * 8/2007 Villarreal et al. ..... 405/36

FOREIGN PATENT DOCUMENTS

| | | | |
|---|---|---|---|
| DE | 1 940 088 | U | 6/1966 |
| DE | 24 47 871 | A1 | 4/1976 |
| DE | 26 15 800 | A1 | 10/1977 |
| DE | 295 03 911.6 | U1 | 6/1995 |
| DE | 44 25 940 | C1 | 2/1996 |
| DE | 196 20 978 | A1 | 1/1997 |
| DE | 196 10 858 | A1 | 9/1997 |
| DE | 297 02 903 | U1 | 7/1998 |
| DE | 94 22 260 | U1 | 8/1999 |
| DE | 202 17 897 | U1 | 2/2003 |
| GB | 1 444 227 | | 7/1976 |
| GB | 1 586 341 | | 3/1981 |
| WO | WO 81/02906 | A1 | 10/1981 |

* cited by examiner

*Primary Examiner*—Frederick L Lagman
(74) *Attorney, Agent, or Firm*—Panitch Schwarze Belisario & Nadel LLP

(57) ABSTRACT

A surface drainage device, in particular a sink tank is provided for connection to a drainage device or similar water-conducting element. At least one wall section of the surface drainage device is provided for connection to the water-conducting element and includes at least one flat section that is made of an elastomeric material, so that it can be adapted for the connection by a simple tool.

9 Claims, 6 Drawing Sheets

SURFACE DRAINAGE SYSTEM

CROSS-REFERENCE TO RELATED APPLICATIONS

This application is a continuation of International Application No. PCT/EP2004/008301, filed Jul. 23, 2004, which was published in the German language on Feb. 10, 2005, under International Publication No. WO 2005/012661 A1, and the disclosure of which is incorporated herein by reference.

BACKGROUND OF THE INVENTION

The invention relates to a surface drainage device.

In line drainage systems water derived from the surface is generally conducted into an inlet chamber, sink trap or similar container from which it is then transferred into a channel system. If there is no gradient in the surrounding terrain, the depths of the consecutive channels in the system are chosen to be such that their bottom levels form a stepwise gradient. Depending on the site at which the channels are coupled to the inlet chambers, they therefore differ in height, in particular with respect to the internal profile.

To enable channels of different heights to be coupled to an inlet chamber, various constructions are known. In particular, attempts have already been made to couple trains of channels by means of insertion parts that have different heights, or can be coupled at different heights, as is known, for example, from German published patent applications DE 24 47 871 A1, DE 26 15 800 A1 and DE 44 25 940 A1 and German utility model DE 295 03 911 U1. The known systems, however, are of very elaborate construction, which affects both their manufacture and also the effort of installing them, in particular when it comes to adjusting them with respect to the various channel heights.

BRIEF SUMMARY OF THE INVENTION

It is an objective of the present invention to provide a surface drainage device that reduces the effort required for both manufacture and assembly at the construction site.

This objective is achieved in the case of a surface drainage system, in particular an inlet chamber, sink trap, branch channel, or similar drainage device, to which a drainage channel or similar water-conducting element is to be attached, in that it comprises at least one wall section for attachment of the water-conducting element, wherein the wall section comprises at least one flat section made of an elastomeric material.

An aim of the invention is that the drainage device, which itself consists of massive material that can support heavy loads, is combined with an elastomeric material or is constructed in part of such material, so that simple tools can be used to adapt this wall section to the water-conducting element that is to be coupled thereto. Therefore, less effort is required, both for manufacture and for assembly. The installation of several such wall sections in the drainage device is also easily possible.

Preferably, the surface drainage device is cast from concrete, in particular concrete polymer, which ensures high stability of the overall arrangement as well as a good bonding connection between the material of the surface drainage device and the elastomeric section.

Preferably, the flat section made of elastomeric material is poured into a surrounding wall section, and hence merely constitutes a section that is part of the associated wall. As a result, adequate stability of the overall arrangement is guaranteed. The casting process generates a fluid-tight connection between the cast element and the inlet chamber.

Preferably, the flat section is provided at its edge with an anchoring section by which a firm connection between the flat section and the device as a whole is ensured. The anchoring section is oriented at least partially at an angle to a main plane within which the flat section extends, or comprises a thickening, such that a stable and tightly sealed anchoring can be produced by simple means.

Preferably, the flat section comprises template arrangements that each correspond to an inner profile of a water-conducting element that could be attached to the flat section, so that the template can be used to cut out the flat section in correspondence with the required inner profile. This is made possible in particular by the fact that the channels are customarily standardized with respect to their height, so that the template with its various markings can be designed in advance in accordance with the various channel heights.

The template arrangements are preferably provided on a side of the flat section that faces away from the water-conducting element that is to be attached. This makes it possible for the assembler to view the template arrangement in its entirety, because it is freely and openly exposed.

The template arrangements preferably comprise a plurality of grooves for positioning a knife or similar cutting tool and marking its course. Hence, only very little skill is needed to undertake correct positioning and correct cutting of the elastomeric wall section.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

In the following description, the same reference numerals are used for identical parts and parts with identical actions.

DETAILED DESCRIPTION OF THE INVENTION

Figure 1:
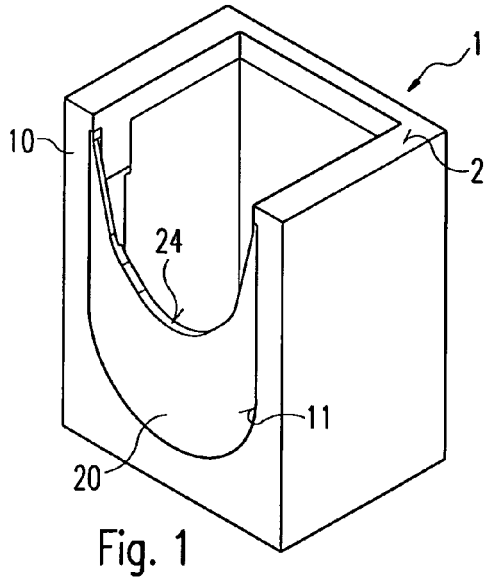
FIG. 1 is a schematic perspective view showing the structure of a drainage device with a wall section made of elastomeric material according to one embodiment of the invention.
Figure 2:
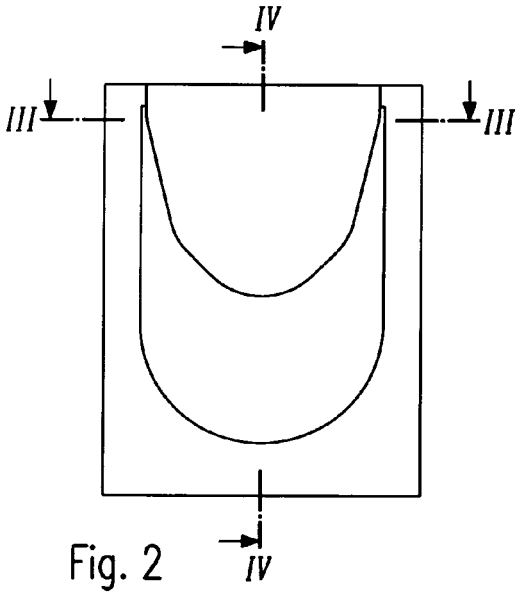
FIG. 2 is a front view of the arrangement according to FIG. 1.
Figure 13:
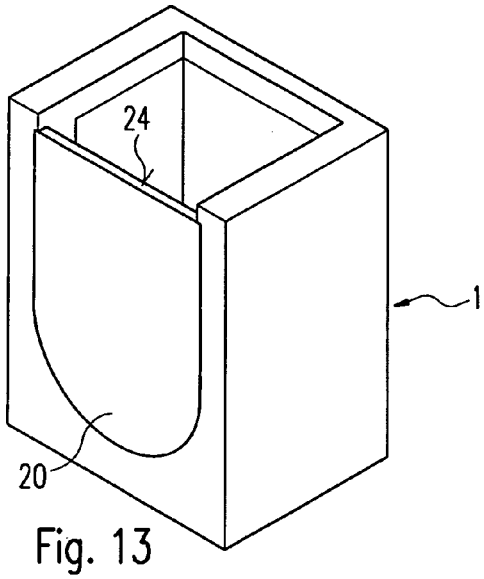
FIG. 13 is a perspective view of another embodiment of the invention, similar to that in FIG. 1.
Figure 14:
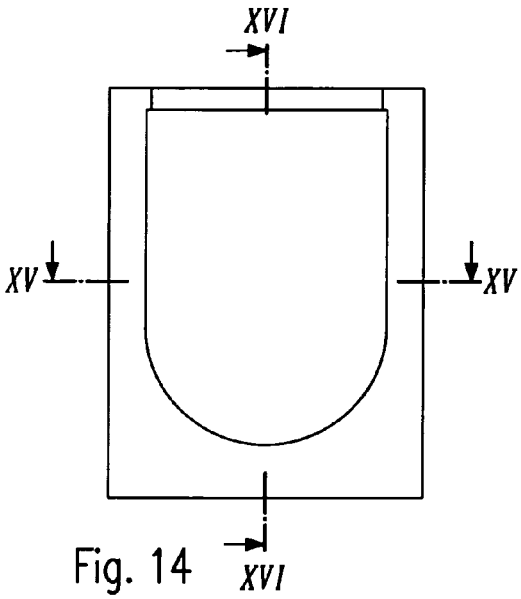
FIG. 14 is a front view of the arrangement according to FIG. 13.
Figure 16:
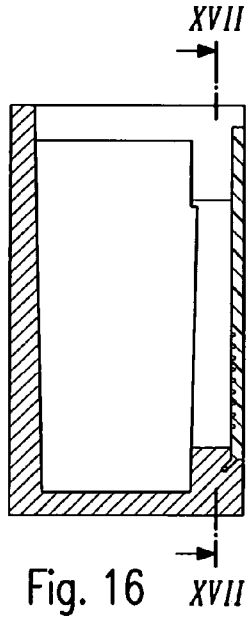
FIG. 16 is a section along the line XVI-XVI in FIG. 14.
Figure 15:
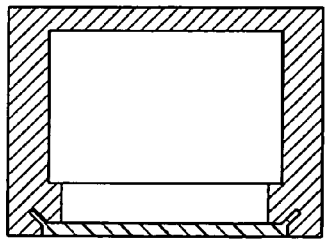
FIG. 15 is a section along the line XV-XV in FIG. 14.
Figure 17:
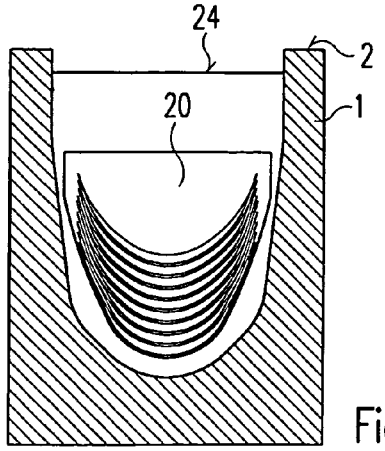
FIG. 17 is a section along the line XVII-XVII in FIG. 16.
Figure 19:
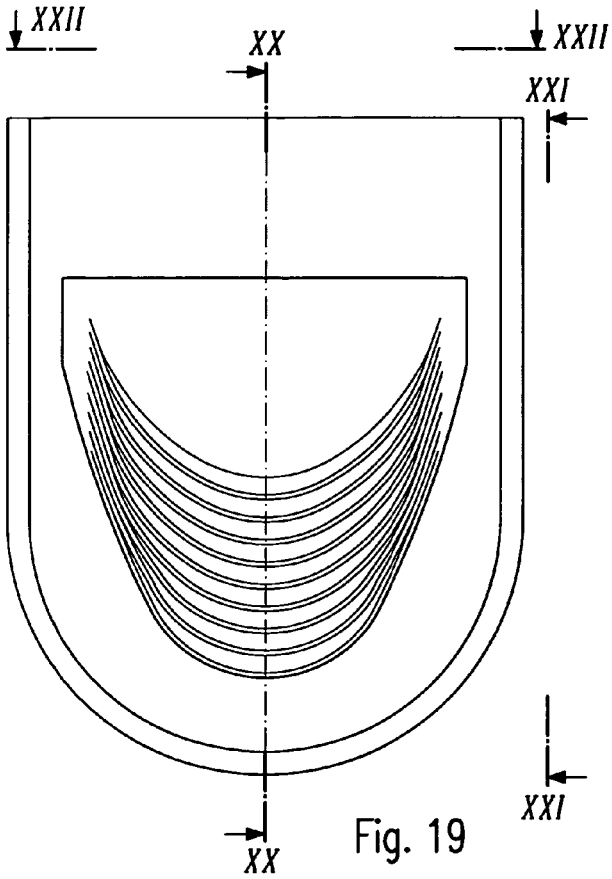
FIG. 19 is a back view of the flat section according to FIG. 18.
Figure 20:
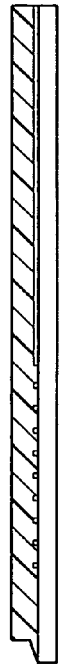
FIG. 20 is a section along the line XX-XX in FIG. 19.
Figure 21:
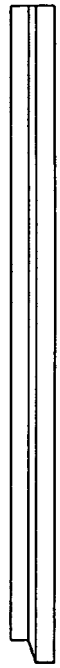
FIG. 21 is a view along the line XXI-XXI in FIG. 19.
Figure 22:
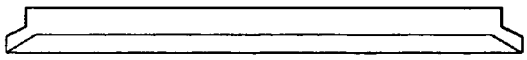
FIG. 22 is a view along the line XXII-XXII in FIG. 19.
Figure 18:
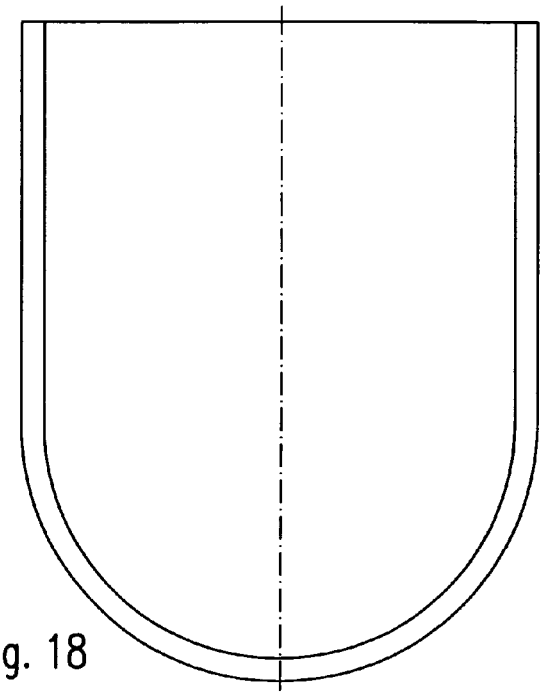
FIG. 18 is a front view of the flat section according to FIG. 13.

It should also be emphasized that the shape and the intended use of the drainage device according to FIG. 1 or 13 are not limited. This component can be an inlet chamber, a sink trap or also a drainage channel to which additional channel elements are to be attached in order to form a T-piece or a crossing.

As shown in FIG. 1, an inlet chamber 1 is provided, on the upper side of which a cover grating is provided as usual. The inlet chamber 1 comprises a wall section 10, in which a cutout 11 is provided. The cutout 11 is shaped so that the maximal height of the profile of a drainage channel to be joined thereto can be connected so as to be flush therewith.

Figure 4:
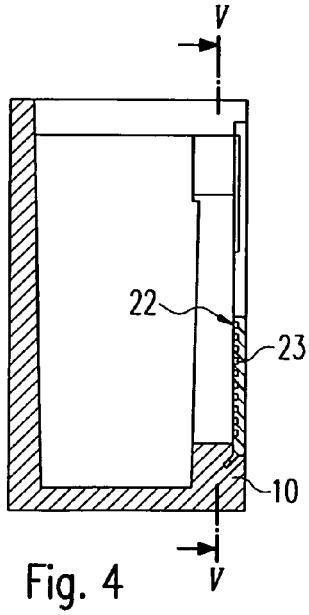
FIG. 4 is a section along the line IV-IV in FIG. 2.
Figure 3:
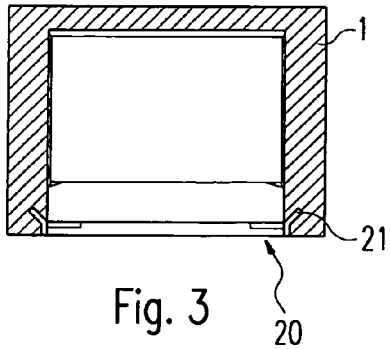
FIG. 3 is a section along the line III-III in FIG. 2.
Figure 5:
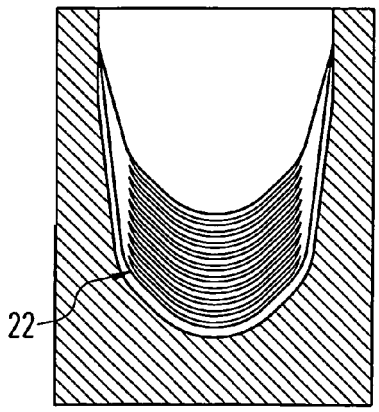
FIG. 5 is a section along the line V-V in FIG. 4.
Figure 7:
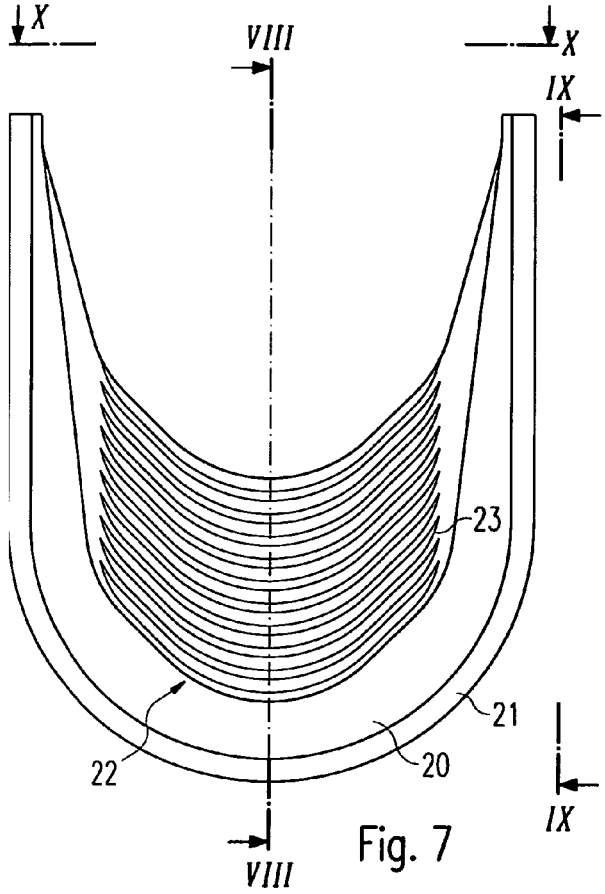
FIG. 7 is a rear view of a wall section.
Figure 8:
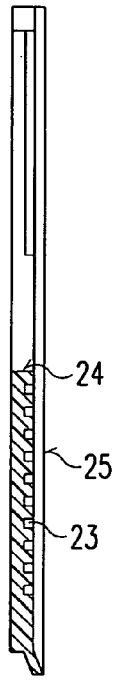
FIG. 8 is a section along the line VIII-VIII in FIG. 7.
Figure 9:
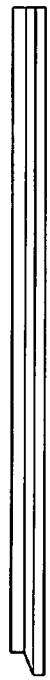
FIG. 9 is a view along the line IX-IX in FIG. 7.

Within the wall section 10, closing off part of the cutout 11, a flat section 20 is provided made of an elastomeric material, in particular a soft plastic or rubber material. On the surface of the flat section 20 that can be seen from the interior of the inlet chamber 1, as shown in FIG. 5, there are template arrangements 22 which, as shown in FIG. 4, each comprise one of a series of grooves that are separated from one another by ridges. In this exemplary embodiment an upper edge 24 of the flat section 20 is configured such that it corresponds to the inner profile of a drainage channel with minimal height. The grooves, i.e., template markings, shown in FIGS. 4 and 5 are shaped so as to correspond to the (standardized) channel heights for various channels in a gradient sequence. Therefore, any of the channels in the gradient sequence can be attached, and it is not necessary to begin with a particular channel as has previously been the case.

Figure 10:
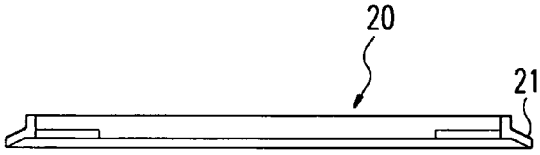
FIG. 10 is a view along the line X-X in FIG. 7.
Figure 6:
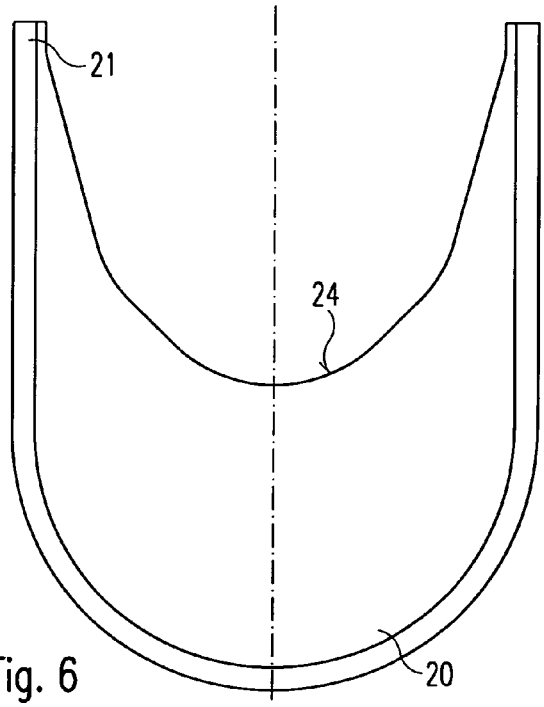
FIG. 6 is a front view of a wall section.

The flat section 20 comprises at its outer edges anchoring sections 21, which are shown very clearly in particular in FIG. 10. These anchoring sections 21 are cast into the (concrete polymer) material of the inlet chamber 1, i.e., into its wall section 10, so that it is impossible for the flat section 20 to be torn out, and a fluid-tight connection is created between the poured-in template arrangement and the concrete polymer.

Figure 11:
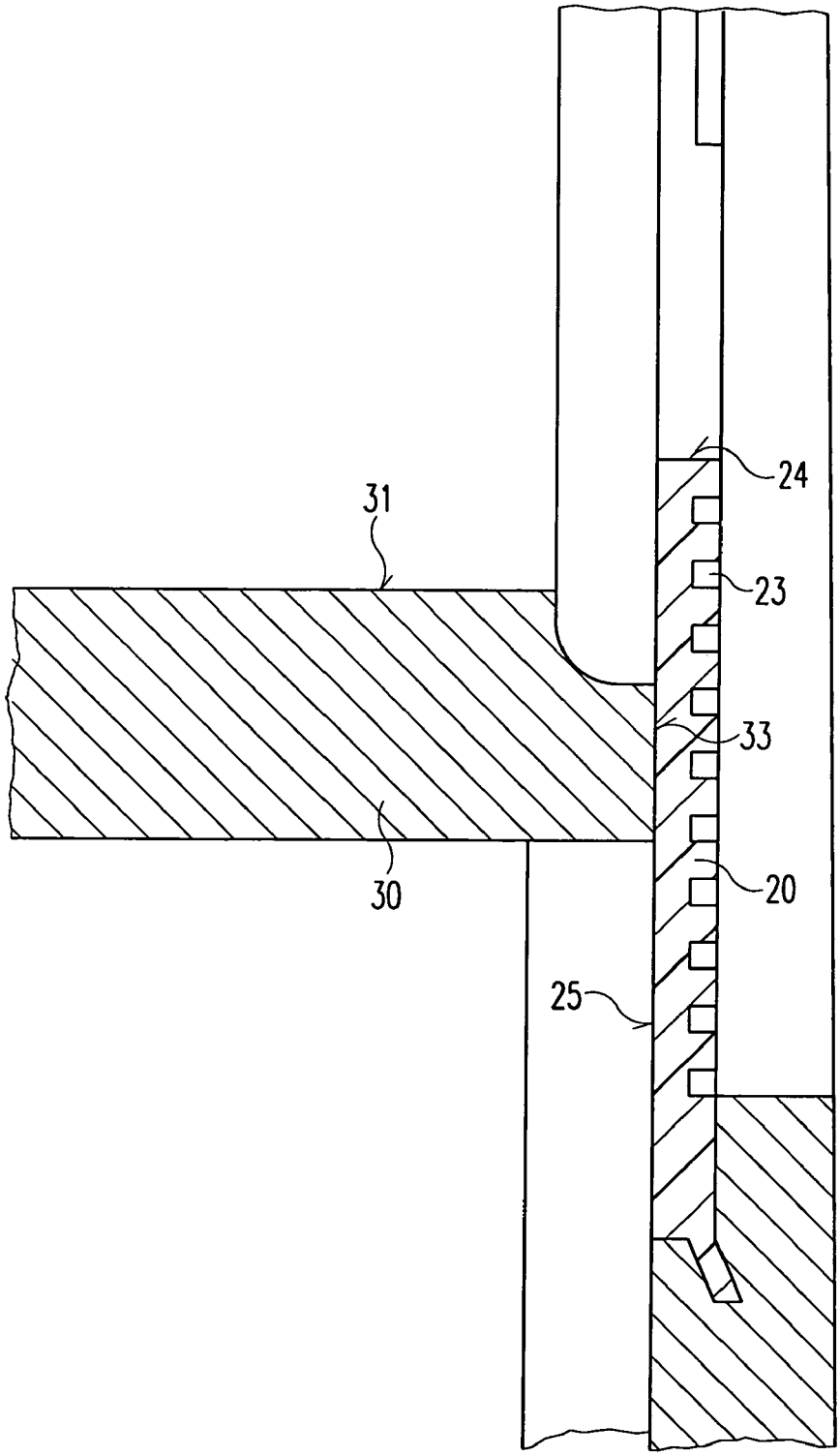
FIG. 11 is a schematic sectional view of a vertical section through an embodiment of a surface drainage device in accordance with the invention, with attached water-conducting element prior to adjustment of the flat section.
Figure 12:
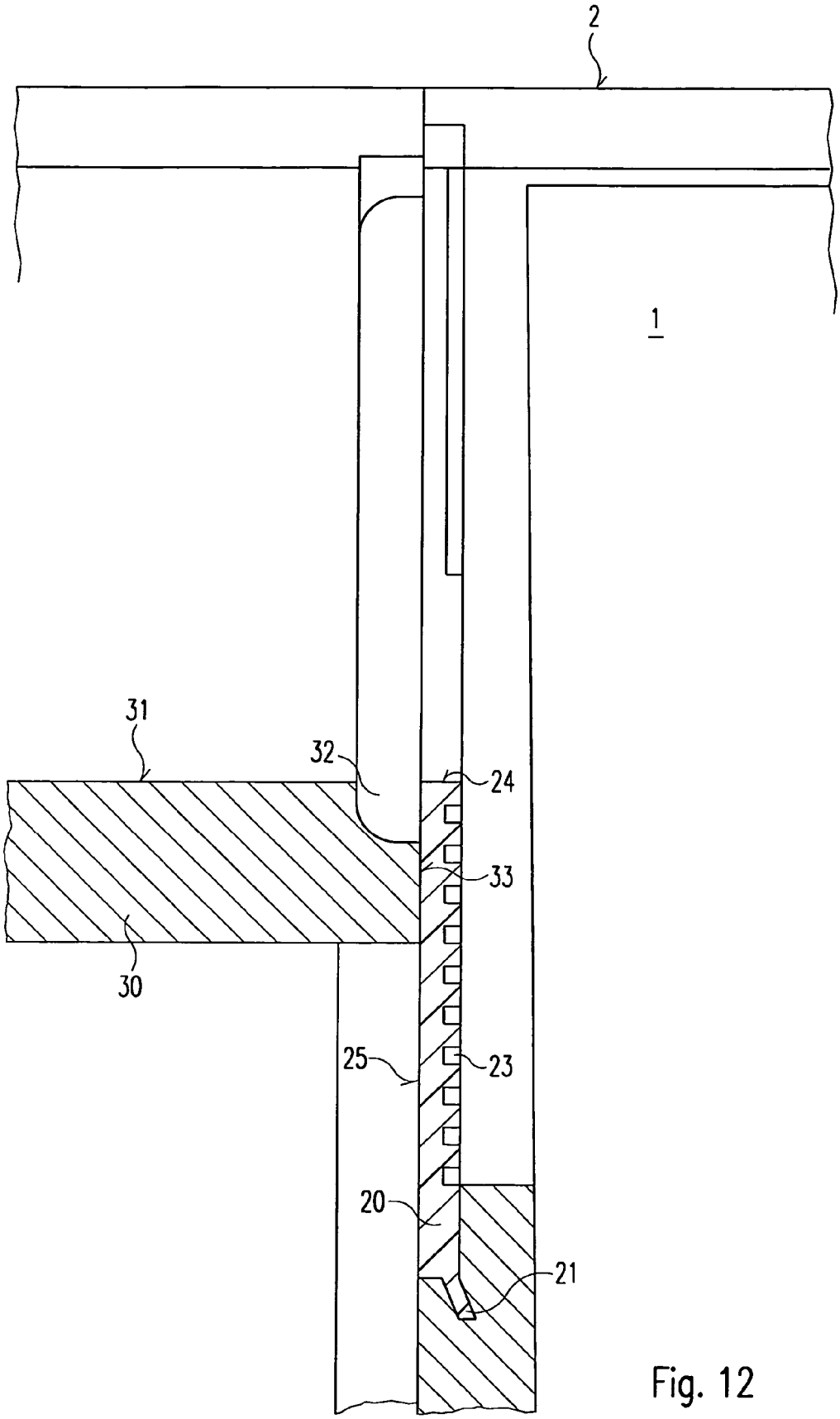
FIG. 12 is a view similar to that in FIG. 11, but after adjustment.

The procedure for assembly begins with the placement of a channel 30 against the inlet chamber 1, as shown in FIG. 11. A front surface 33 of the channel 30 thus abuts against a planar outer surface 25 of the flat section 20. In the situation shown in FIG. 11, the inner profile 31 of the channel 30 is deeper than the upper edge 24 of the flat section 20. Now, so as to create a smooth transition, a knife is inserted into a groove 23 and passes through the flat section 20 to a depth such that the knife is in contact with the inner profile 31 of the drainage channel 30. Then, the knife is used to cut all around the inner profile 31 of the channel 30, so that a corresponding strip is separated from the flat section 20, until the shape shown in FIG. 12 is produced. Now a sealing trough 32 provided at the end face of the channel 30 is filled with a sealing material, which simultaneously forms a firm connection with both the material of the channel 30 and the material of the flat section 20, so that the transition from the channel 30 to the sink trap 1 is tightly sealed.

The embodiment of the invention shown in FIGS. 13-22 differs from that according to FIGS. 1-12 in that the upper edge 24 of the flat section 20 is positioned at substantially the full height of the inlet chamber 1, which offers advantages during the process of pouring in the flat section 20.

It is of course also possible for the flat section 20 to be provided with an anchoring section 21 over its entire periphery, so that the wall section it forms in a drainage device, in particular a drainage channel, is tightly sealed and need not be cut out unless it is needed for coupling to an additional channel element at the side, i.e., to form a T-piece. It is likewise possible to install a flat section 20 made of elastomeric material at the floor of a surface drainage device, so that outlet pipes can be attached.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A surface drainage system comprising:

a water-conducting element having a sealing trough at its end face;

a surface drainage device comprising at least one wall section connected to the end face of the water-conducting element, wherein the wall section comprises at least one flat section comprising at least partially an elastomeric material; and a sealing material filling the sealing trough, the sealing material forming a connection between the end face of the water-conducting element and the flat section, such that a transition from the water-conducting element to the surface drainage device is tightly sealed.

2. The surface drainage system according to claim 1, wherein the surface drainage device is made of at least one of cast concrete and cast concrete polymer.

3. The surface drainage system according to claim 2, wherein the flat section is cast into a surrounding portion of the wall section and is bonded to the concrete and/or concrete polymer.

4. The surface drainage system according to claim 3, wherein the flat section comprises an anchoring section at its edge.

5. The surface drainage system according to claim 4, wherein the anchoring section is oriented at least partially at an angle to a main plane in which the flat section extends.

6. The surface drainage system according to claim 1, wherein the flat section comprises template arrangements, wherein at least one of the template arrangements corresponds to an inner profile of the water-conducting element such that a portion of the flat section can be cut out to correspond to the inner profile.

7. The surface drainage system according to claim 6, wherein the template arrangements comprise a plurality of markings corresponding to different heights of inner profiles of a plurality of different profile water-conducting elements that can be connected to the device.

8. The surface drainage system according to claim 6, wherein the template arrangements comprise a plurality of grooves for marking and for placement of a cutting tool.

9. The surface drainage system according to claim 6, wherein the template arrangements are provided on a side of the flat section facing away from a side to which the water-conducting element is to be connected.

* * * * *